United States Patent [19]

Yamaguchi et al.

[11] Patent Number: 4,461,992

[45] Date of Patent: Jul. 24, 1984

[54] TEMPERATURE-COMPENSATED CURRENT SOURCE CIRCUIT AND A REFERENCE VOLTAGE GENERATING CIRCUIT USING THE SAME

[75] Inventors: Kunihiko Yamaguchi, Sayama; Noriyuki Homma, Kokubunji, both of Japan

[73] Assignee: Hitachi, Ltd., Tokyo, Japan

[21] Appl. No.: 367,676

[22] Filed: Apr. 12, 1982

[30] Foreign Application Priority Data

Apr. 15, 1981 [JP] Japan ..... 56-55552

[51] Int. Cl.[3] ..... G05F 3/20

[52] U.S. Cl. ..... 323/313; 323/907; 307/297

[58] Field of Search ..... 323/312, 313, 314, 315, 323/316, 907; 307/296 R, 297, 310

[56] References Cited

U.S. PATENT DOCUMENTS 4,319,180 3/1982 Nagano ..... 323/313

4,335,346 6/1982 Streit ..... 323/907 X

*Primary Examiner*—Peter S. Wong

*Attorney, Agent, or Firm*—Antonelli, Terry & Wands

[57] ABSTRACT

A current source circuit includes a first and a second transistor connected at the collector to a common load resistor. In the current source circuit, the emiiters of the first and second transistors are connected to a negative power source through different current restricting resistors. The base of the first transistor is biased by a series circuit including two diodes. The temperature coefficients of the collector currents of the first and second transistors are offset, so that the temperature-compensated current flows into the load resistor.

8 Claims, 8 Drawing Figures

TEMPERATURE-COMPENSATED CURRENT SOURCE CIRCUIT AND A REFERENCE VOLTAGE GENERATING CIRCUIT USING THE SAME

The present invention relates to a current source circuit for semiconductor devices and a reference voltage generating circuit using the same and, more particularly, to a circuit arrangement well adaptable for emitter-coupled logics (ECL).

The semiconductor devices, particularly integrated circuits using ECL, require a current source circuit for feeding current which is accurately temperature-compensated and further compensated for changes in a power supply voltage externally supplied thereto with a relatively high accuracy. The principle of the temperature compensation often employed in this type of the circuit is based on the fact that each of two transistors operating with a different current density has a base-emitter voltage ($V_{BE}$) with a different temperature coefficient.

A voltage regulator disclosed in U.S. Pat. No. 3,781,648 employs a current source circuit with the temperature-compensating function based on the foregoing principle. In this type of current source circuit, an amount of the current produced therefrom influences the current density of the transistor. Therefore, circuit constants must be adjusted for finally obtaining a desired amount of current with a desired temperature coefficient and this adjustment is very difficult and cumbersome.

Accordingly, an object of the present invention is to provide a current source circuit in which it is easy to adjust circuit constants for obtaining a desired amount of current with a desired temperature coefficient.

Another object of the present invention is to provide a current source circuit which can feed a substantially constant current, when considered from a practical view-point, irrespective of changes in an ambient temperature and a power supply voltage.

In accordance with the present invention, there is provided a current source circuit comprising: a first and a second common line having an external power source connected therebetween; a load resistor connected at one end to the first common line; a first and a second transistor each connected at the collector to the other end of the load resistor, and at the emitter to the second common line through respective current restricting resistors; a first bias element connected to the base of the first transistor and for biasing the base potential thereof by a forward voltage-drop across a single PN junction with respect to the potential on the second common line, and a second bias element connected to the base of the second transistor and for biasing the base potential thereof by a forward voltage-drop across a plurality of PN junctions with respect to the potential on the second common line, the current flowing through the first transistor to the load has a positive temperature dependency of the junction temperature of the transistors and bias elements, and the current flowing into the load through the second transistor has a negative temperature dependency of the junction temperature, whereby a current with a minute temperature coefficient can be supplied to the load by adjusting a ratio of the respective currents flowing through the first and second transistors, and also the current substantially insensitive to a temperature change can be supplied.

Other objects, features and advantages of the present invention will become apparent from the following detailed description of preferred embodiments thereof taken in conjunction with the accompanying drawings, in which.

Before proceeding with description of the embodiments of the present invention, two prior art examples will be described referring to FIGS. 1 and 2, for better understanding of the present invention.

Figure 1:
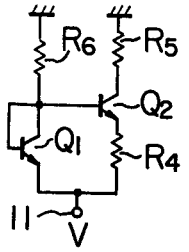
FIG. 1 PRIOR ART
FIG. 1 is a circuit diagram of an example of a prior art current source circuit.

In FIG. 1 illustrating one of the prior art current source circuits, the collector of the transistor Q2 is grounded through a load resistor R5 and the emitter thereof is connected through a resistor R4 to a terminal 11 to which a negative voltage of an external power source is applied. A series circuit including a resistor R6 and a transistor Q1, which is used in a diode mode with the connection of the base and collector, is connected between the terminal 11 and ground. The connection point between the transistor Q1 and the resistor R6 is connected to the base of the transistor Q2. In the circuit, a current I flowing through the load resistor R5 is given $$I = V_{BE1} - V_{BE2}/R4 \quad (1)$$

where $V_{BE1}$ is a base-emitter voltage drop of the transistor Q1 and $V_{BE2}$ is a base-emitter voltage-drop of the transistor Q2. A constant current can be obtained as represented by the relation (1), with the emitter current density of the transistor Q1 being made larger than that of the transistor Q2, and however the base-emitter voltage-drop $V_{BE}$ of a transistor or a forward voltage drop of a PN junction has a negative temperature coefficient of about 1 mV/degree against a junction temperature. The temperature coefficient approaches zero as the current density becomes larger. The current I derived from the equation (1) has a positive temperature coefficient.

Figure 2:
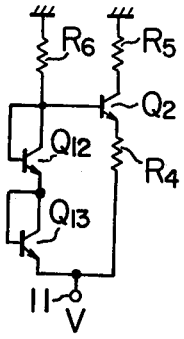
FIG. 2 PRIOR ART
FIG. 2 is a circuit diagram of another example of the prior art current source circuit.

FIG. 2 shows another current source circuit of the prior art. This circuit is different from the circuit shown in FIG. 1, in that a series circuit of two diode-connected transistors Q12 and Q13 is connected between the base of the transistor Q2 and the terminal 11. In the current source circuit, the base-emitter voltage-drop of the transistor Q2 and the forward voltage-drop of the transistor Q12 are cancelled by each other, and therefore the current I flowing into the load resistor R5 is substantially given by the following equation, where $V_{BE(Q13)}$ denotes the base-emitter voltage-drop of the diode-connected transistor Q13:

$$I = V_{BE(Q13)}/R4 \quad (2)$$

Accordingly, the current I flowing through the load resistor R5 has a negative temperature coefficient.

Figure 3:
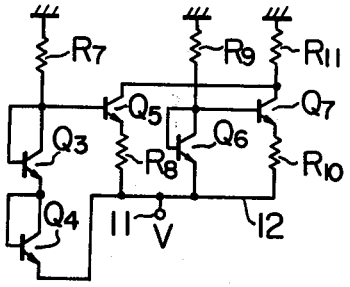
FIG. 3 is a circuit diagram of a first embodiment of a current source circuit according to the present invention.
Figure 4:
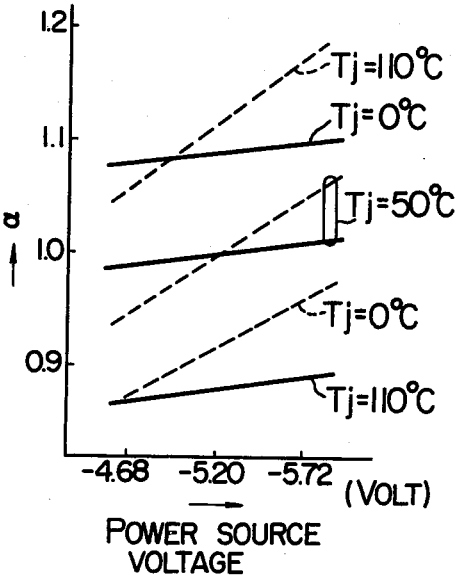
FIG. 4 PRIOR ART
FIG. 4 illustrates characteristics of output currents of the circuit shown in FIG. 3.

FIG. 3 is a first embodiment of the present invention. The circuit is so arranged that the circuits of FIGS. 1 and 2 are connected in parallel. The collectors of the transistors Q5 and Q7 are connected together to the other end of the load resistor R11. The emitters of the transistors Q5 and Q7 are connected to the node 12 through the resistor R10. A negative power source voltage V is applied to the terminal 11 coupled with the node 12. A first bias element including a series circuit made up of the resistor R9 and the diode-connected transistor Q6, and a second bias element including a series circuit made up of a resistor R7, a diode-connected transistor Q3 and a diode-connected transistor Q4, are connected between the node 12 and ground. A connection point between the resistor R9 and the diode-connected transistor Q3 is connected to the base of the transistor Q7. A connection point between the resistor R7 and the diode-connected transistor Q3 is connected to the base of the transistor Q5. The diode-connected transistors Q3, Q4 and Q6 may be replaced by the ordinary PN junction diodes. The current I flowing into the load resistor R11 is the sum of the currents I given by the equations (1) and (2), and it is easily attained to stabilize the current irrespective of changes of a temperature.

Figure 5:
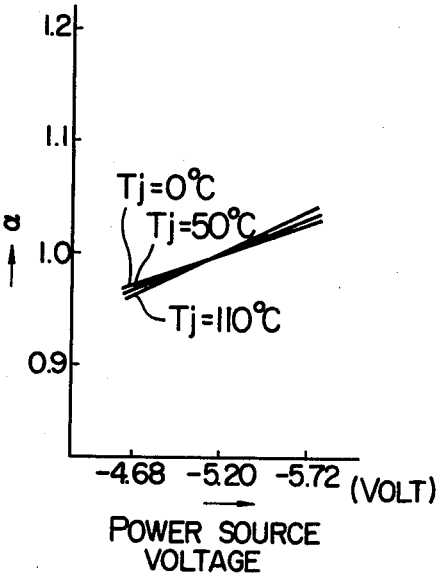
FIG. 5 is a graph illustrating how the load current ratio $\alpha$ changes when a power source voltage changes.

FIG. 5 shows how a load current ratio $\alpha$ changes when the power source voltage changes from −4.68 V to −5.72 V and the junction temperature changes from 0° C. to 110° C. under a condition that the power source voltage is −5.2 V, temperature is expressed in terms of junction temperature (Tj), and the current I is 1.0 at 50° C. In the graph, broken lines indicate characteristics of the circuit shown in FIG. 1 when the emitter size of the transistor Q2 is four times that of the transistor Q1 (actually, four transistors each having the same size as that of the transistor Q1 connected in parallel are used for the transistor Q2), and the resistors R4 and R6 are 131.7 ohms and 14.55 thousand ohms so that the emitter currents of both transistors Q1 and Q2 are 0.3 mA. Solid lines indicate characteristics of the circuit shown in FIG. 1 when the transistors have all the same emitter size of 4 $\mu m^2$, and 0.3 mA as the emitter current flows through the transistors (the resistance of the resistors R1 and R3 are 11.9 thousand ohms and 2.6 thousand ohms).

FIG. 5 shows the experimental results of the embodiment of the present invention shown in FIG. 3 when the current generated in the circuit corresponding to that shown in FIG. 1 and the current generated in a circuit corresponding to that shown in FIG. 2 are 1:1. In this experiment, the emitter size of the transistors Q3 to Q6 is 4 $\mu m^2$, like the prior art, the emitter size of the transistor Q7 is four times that of the remaining ones, and the resistance of the resistors R7 to R10 are 1.9 thousand ohms, 2.6 ohms, 14.55 thousand ohms and 131.7 ohms so that the emitter current of all the transistors is 0.3 mA. A change of the current I with a change of the power source voltage is slightly larger than that of the circuit of FIG. 2. The change of the current I as a function of a change of the junction temperature is little. A change of the current I as a function of the change of the junction temperature is reduced to a value which is practically negligible.

In the circuit shown in FIG. 3, the current I flowing into the load can be substantially constant by setting the ratio of the currents flowing through the transistors Q5 and Q7 to a proper value. Current I with a proper minute temperature coefficient can be supplied by properly selecting the current ratio, that is, adjusting the resistors R8 and R10 properly. If the load resistor R11 is selected to have a proper resistance, a reference voltage compensated for changes in temperature and the power source voltage can be obtained from the connection point of the transistors Q5 and Q7.

Figure 6:
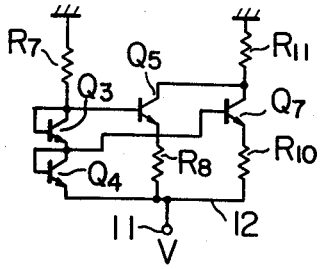
FIG. 6 is a circuit diagram of a second embodiment of a current source circuit according to the present invention.

FIG. 6 shows a second embodiment of the present invention. The current source circuit shown in FIG. 6 partially uses the two bias elements of the current source circuit shown in FIG. 3. The base of the transistor Q7 is connected to a connection point of the transistors Q3 and Q4. With this connection, a bias voltage corresponding to the bias voltage corresponding to the voltage-drop of the PN junctions of two stages of the transistors Q3 and Q4 is applied to the base of the transistor Q5. A bias voltage corresponding to the voltage-drop across the PN junction of a single stage of PN junction is applied to the transistor Q7. Accordingly, the temperature-compensated current I can be obtained, like the emobidment of FIG. 3.

Figure 7:
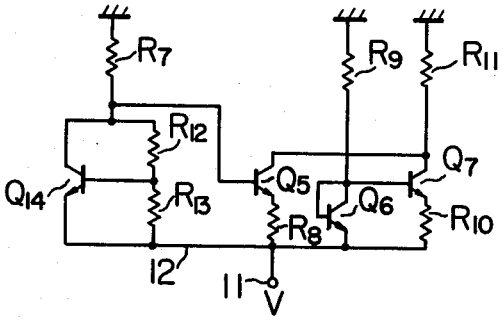
FIG. 7 is a circuit diagram of a third embodiment of a current source circuit according to the present invention.

The transistors Q3 and Q4 shown in FIG. 3 may be replaced by other suitable elements which exhibit a forward voltage-drop across the PN junctions of a plurality of stages, without using two diodes connected in series. FIG. 7 shows a third embodiment in which a transistor Q14 in which a resistor R12 is connected between the base and collector and a resistor R13 is connected between the base and emitter, is used in place of the transistors Q3 and Q4 shown in FIG. 3. In the circuit, the voltage-drop across the collector-emitter path of the transistor Q14 has a value $V_{BE(Q14)} \times (1 + R12/R13)$ with respect to the base-emitter voltage drop $V_{BE(Q14)}$. Accordingly, the current I flowing into the resistor R11 is $$I = \frac{V_{BE(Q14)} \times \left(1 + \frac{R_{12}}{R_{13}}\right) - V_{BE(Q5)}}{R_{14}} + \frac{V_{BE(Q6)} - V_{BE(Q7)}}{R_{15}} \quad (3)$$

Accordingly, the circuit of FIG. 7 can provide the temperature-compensated current I, like the circuit shown in FIG. 3. In order to obtain the current I of which the temperature coefficient is almost zero, it is desirable to set the value of R12/R13 below 1.

Figure 8:
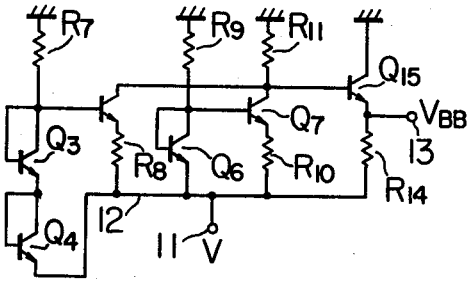
FIG. 8 is a circuit diagram of a practical arrangement of a reference voltage generating circuit according to the present invention.

FIG. 8 shows a practical arrangement of a reference voltage generating circuit using the current source circuit shown in FIG. 3. A reference voltage $V_{BB}$ is obtained from the output terminal 13 through an emitter follower made up of the transistor Q15 and the resistor R14. The voltage drop $V_{BB}$ is the collector voltage of the transistor Q7 dropped by the emitter-base voltage-drop $V_{BE}$ of the transistor Q15. The voltage drop $V_{BE}$ has a negative temperature coefficient. In order to obtain the temperature-compensated reference voltage $V_{BB}$, the current I flowing through the resistor R11 must has a positive temperature coefficient enough to offset the temperature coefficient of the $V_{BE}$ of the transistor Q15.

What is claimed is:

1. A current source circuit comprising:

a first and a second common line having an external power source connected therebetween;

a load element connected at one end to said first common line;

a first and a second transistor connected at the collector to the other end of said load element, and at the emitter to said second common line respectively through a first and a second current restricting resistor;

first bias means including a first base resistor connected between said first common line and the base of said first transistor, and first voltage-drop means connected between the base of said first transistor and said second common line, said first voltage-drop means generating a forward voltage-drop across a single PN junction caused by a current supplied through the first base resistor; and second bias means including a second base resistor connected between said first common line and the base of said second transistor, and second voltage-drop means connected between the base of said second transistor and said second common line, said second voltage-drop means generating a forward voltage drop across a plurality of PN junctions caused by a current supplied through the second base resistor.

2. A current source circuit according to claim 1, wherein said first voltage-drop means includes a diode.

3. A current source circuit according to claim 2, wherein said diode is a transistor of which the collector and the base are connected.

4. A current source circuit according to claim 1, wherein said second voltage-drop means includes a series circuit having two diodes.

5. A current source circuit according to claim 4, wherein each of said two diodes is a transistor of which the collector and the base are connected.

6. A current source circuit according to claim 1, wherein said second voltage-drop means includes a third transistor connected at the collector to the base of said second transistor and at the emitter to said second common line, and having resistors between the emitter and the base and between the base and collector.

7. A reference voltage generating circuit comprising:

a first and a second common line having an external power source connected therebetween;

a load element connected at one end to said first common line;

a first and a second transistor connected at the collector to the other end of said load element and at the emitter to said second common line respectively through a first and a second current restricting resistor;

first bias means including a first base resistor connecting between said first common line and the base of said first transistor, and first voltage-drop means connected between the base of said first transistor and said second common line, said first voltage-drop means generating a forward voltage-drop across a single PN junction caused by a current supplied through the first base resistor;

second bias means including a second base resistor connected between said first common line and the base of said second transistor, and second voltage-drop means connected between the base of said second transistor and said second common line, said second voltage-drop means generating a forward voltage drop across a plurality of PN junctions caused by a current supplied through the second base resistor; and a junction point between said load element and the collectors of said first and said second transistors functioning as an output terminal.

8. A reference voltage generating circuit comprising:

a first and a second common line having a power source connected therebetween;

a load element connected at one end to said first common line;

a first and a second transistor connected at the collector to the other end of said load element and at the emitter to said second common line respectively through a first and a second respective current restricting resistor;

first bias means including a first base resistor connected between said first common line and the base of said first transistor, and first voltage-drop means connected between the base of the first transistor and said second common line, said first voltage-drop means generating a forward voltage-drop across a single PN junction caused by a current supplied through the first base resistor;

second bias means including a second base resistor connected between said first common line and the base of said second transistor, and second voltage-drop means connected between the base of said second transistor and said second common line, said second voltage-drop means generating a forward voltage drop across a plurality of PN junctions caused by a current supplied through the second base resistor; and an emitter follower circuit connected between said load element and a connection point between the collectors of said first and second transistors for producing a signal output.

* * * * *